United States Patent [19]

Ragland

[11] 4,126,343

[45] Nov. 21, 1978

[54] DOOR JAMB STRIKE PLATE MOUNTING ASSEMBLY

[76] Inventor: Douglas Ragland, Box 852, Houston, Tex. 77001

[21] Appl. No.: 635,888

[22] Filed: Nov. 28, 1975

[51] Int. Cl.[2] ..... E05C 13/00

[52] U.S. Cl. ..... 292/341

[58] Field of Search ..... 292/341.18, 346, 341.19, 292/340, 341

[56] References Cited

U.S. PATENT DOCUMENTS

| | | | |
|---|---|---|---|
| 2,042,024 | 5/1936 | Schlage | 292/341.18 |
| 2,153,080 | 4/1939 | Flora | 292/341.19 |
| 2,884,277 | 4/1959 | Hale | 292/341.18 |
| 3,265,427 | 8/1966 | Williams | 292/341.18 |
| 3,361,466 | 1/1968 | Russell et al. | 292/341.18 |

*Primary Examiner*—Richard E. Moore

*Attorney, Agent, or Firm*—Browning, Bushman & Zamecki

[57] ABSTRACT

A door jamb strike plate mounting assembly comprises a jamb member including a front section having a strike plate opening therein. Insert means are disposed rearwardly of the front section. Support means located rearwardly of and fixed with respect to the front section adjacent the strike plate opening include means which limit rearward movement of the insert means. The insert means include a strike plate mounting surface disposed directly rearwardly of the strike plate opening.

22 Claims, 10 Drawing Figures

FIG. 1
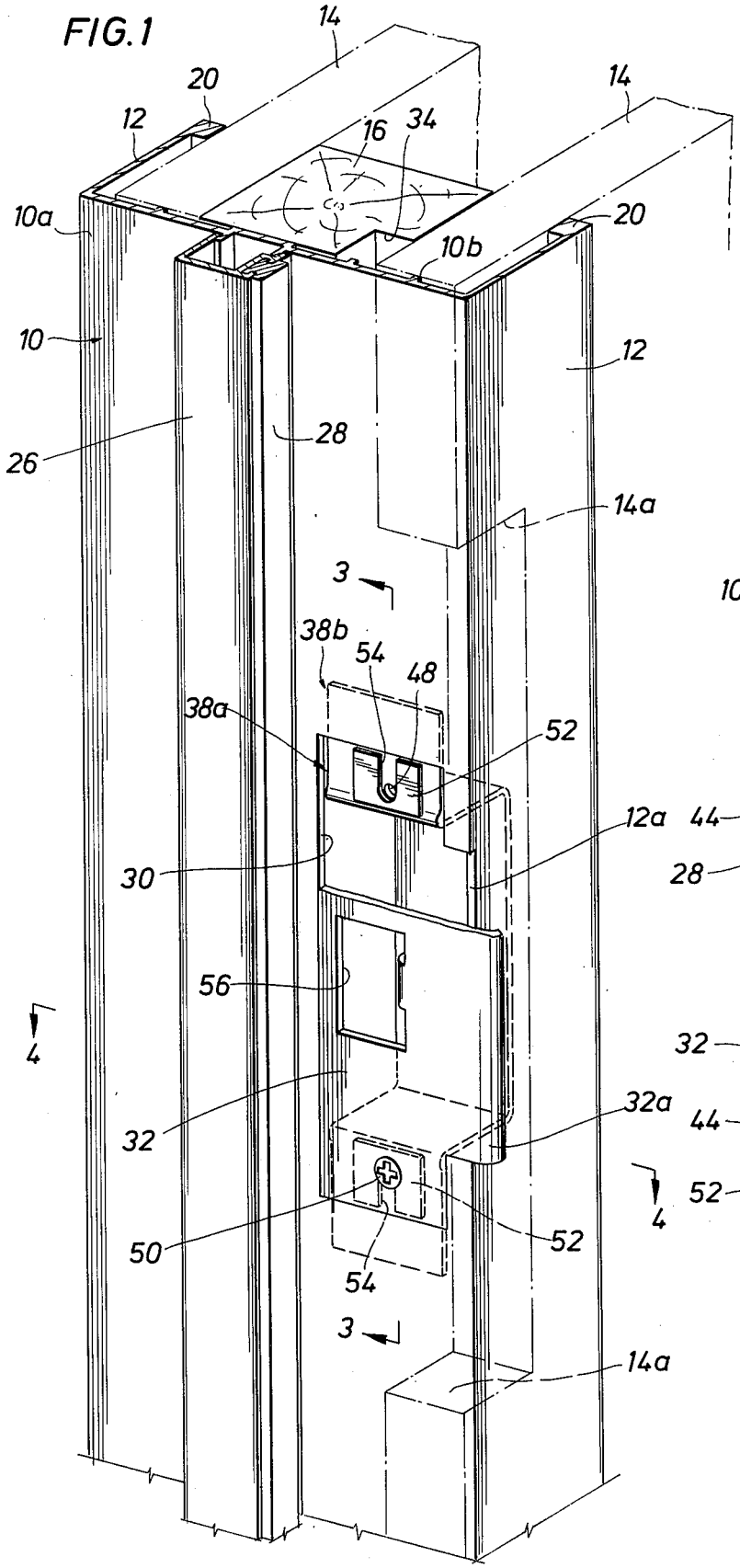
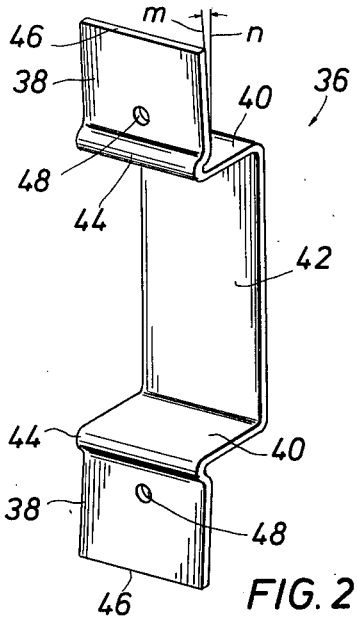
FIG. 2
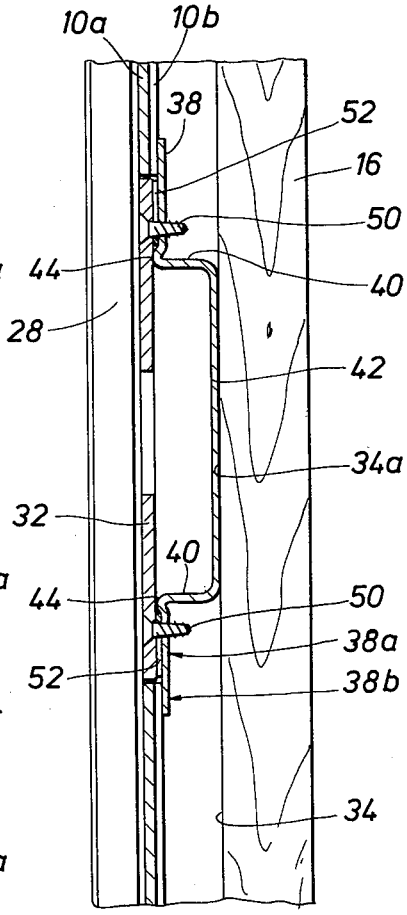
FIG. 3

FIG. 8
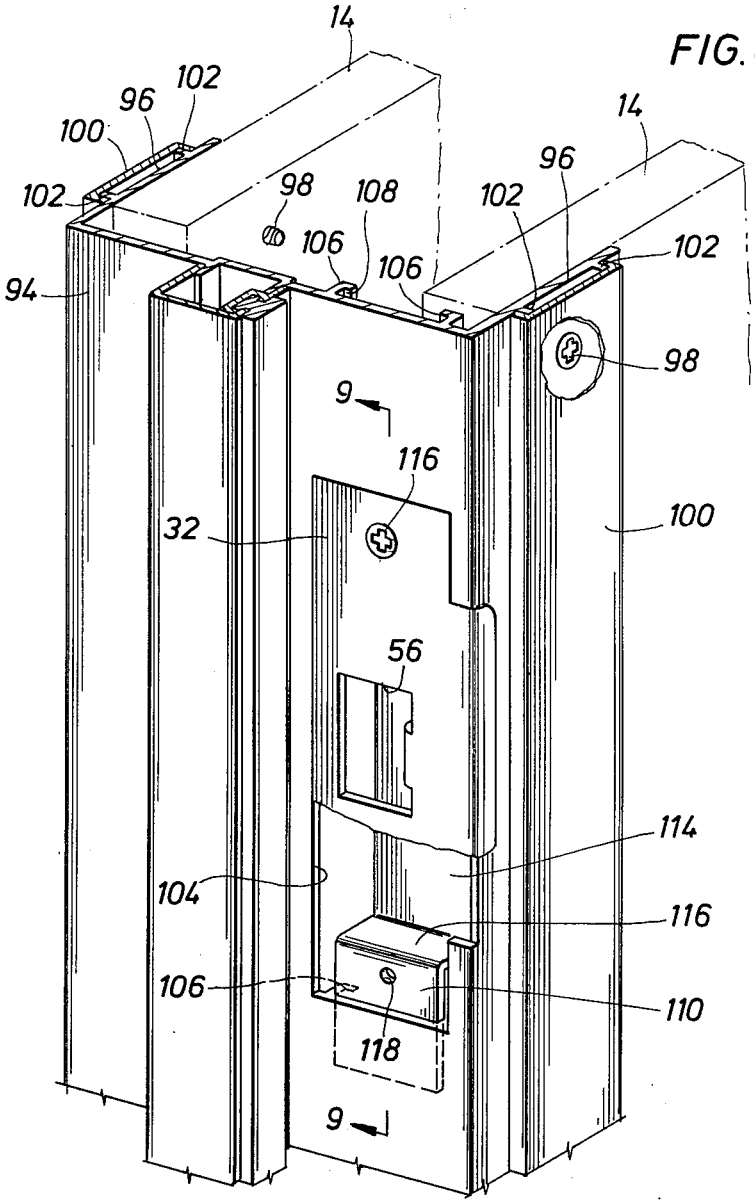
FIG. 9
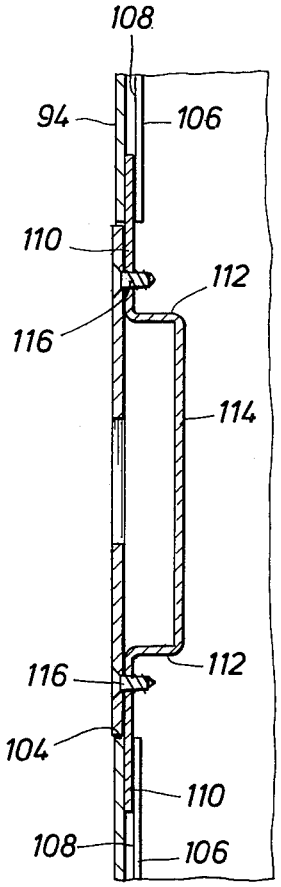
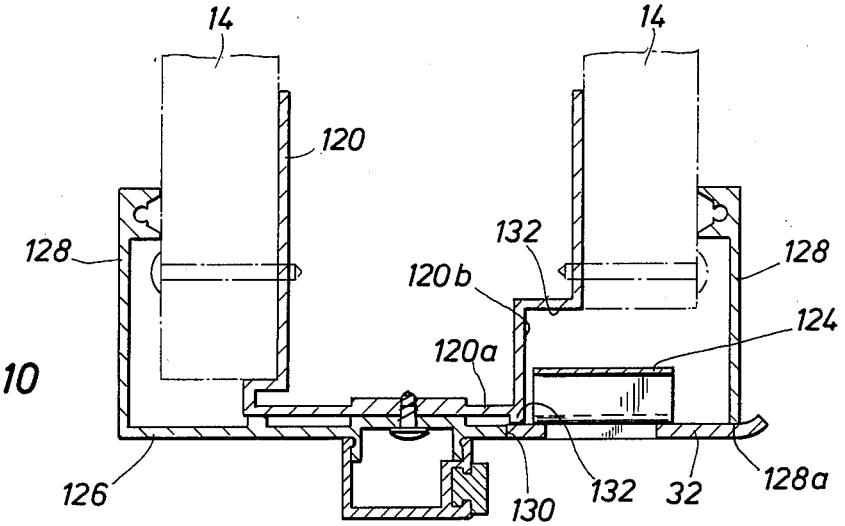
FIG. 10

DOOR JAMB STRIKE PLATE MOUNTING ASSEMBLY

BACKGROUND OF THE INVENTION

1. Field of the Invention

The present invention pertains to an improvement in the strike plate mounting assembly of a door jamb. It is particularly useful in connection with the metal, especially aluminum, door frame assemblies which are frequently used in modern buildings. Such assemblies generally comprise two jamb members, one for each side of the doorway, and a header for the top, all of which may be integral, but which are usually separate prior to their mounting in the doorway. One of the side jamb members and/or an underlying support is used to mount the door while the other side jamb member and/or and underlying support is used to mount a strike plate.

The strike plate has an aperture therein, and a hollow must be provided directly behind this aperture for receipt of the reciprocable latch bolt of the lock in the door. In mounting a strike plate in the metal door jamb it is customary to provide an opening in the jamb itself for receipt of the strike plate. Adjacent this opening, it is necessary to provide mounting surfaces to which the strike plate can be attached while still providing the above mentioned hollow.

2. Description of the Prior Art

Present methods of mounting a strike plate in a metal door jamb are time consuming and hence expensive. If the jamb is steel, a strike plate opening is cut in the jamb member. Plates are then welded to the rear of the steel jamb member prior to its installation so as to project into the area behind the opening. These plates thus provide surfaces exposed by the opening to which the strike plate may be fastened. This method is time consuming and troublesome. Furthermore, it is not, due to the necessary for welding, used with the aluminum door jambs which are becoming increasingly popular.

One of the most common methods employed with aluminum jambs involves the use of the support beam which ordinarily closely underlies and braces the front section of the side jamb member itself (the front section being that part which in use faces into the doorway). A hole is cut in this support beam smaller than the strike plate opening in the jamb. The hole in the support beam provides the necessary hollow while adjacent parts of the support beam exposed through the strike plate opening provide surfaces for support and attachment of the strike plate. Such an arrangement is used in the type of door frame disclosed in U.S. Pat. No. 3,812,621. A modification of this basic approach is illustrated in U.S. Pat. No. 3,676,966. Here a support plate is welded or otherwise rigidly secured to the support beam prior to emplacement of the jamb member so that the support plate effectively becomes an integral part of the support beam. The strike plate is secured to the support plate, and the latter must have a hole of limited size therein.

One of the problems with the above method of mounting the strike plate on the support beam relates to the cutting of the hole in the support beam and proper aligning of this relatively small hole and the adjacent strike plate mounting surfaces with the strike plate opening in the jamb. If the hole is cut prior to mounting of the jamb in the doorway, the strike plate mounting surfaces are not always properly aligned with the strike plate opening due to slight inaccuracies or differences in the construction of various individual doorways. As this prior construction is often incapable of accomodating such differences regarding strike plates with the same general placement on their door jambs, it is not versatile enough to accomodate intentional relatively large variations of the strike plate placement, as in the construction of doorways for children or wheel chair patients. On the otherhand, cutting the hole after mounting of the jamb is awkward, particularly if the support beam is metal, and involves the risk of damage to the jamb. In either case, cutting of such a hole is undesirably time consuming.

SUMMARY OF THE INVENTION

In the present invention, the support stud, beam, or the like underlying the front section of the jamb member does not directly support or mount the strike plate. Rather, this beam or some other support means located rearwardly of the front section of the jamb member provides an insert support surface to limit rearward movement of an insert means. The insert means, which is disposed rearwardly of the front section of the jamb member, provides at least one strike plate mounting surface disposed directly behind the strike plate opening but of lesser area than the strike plate opening to allow for receipt of the latch or lock bolt carried by the door. The support stud or beam may be recessed away from the rear of the front section of the jamb member to provide a hollow behind the aperture in the strike plate. This recess, however, need not be shorter than the strike plate opening but may have a substantial longitudinal extent to provide as much versatility as to the placement of the strike plate as desired. The stud can even be recessed along its entire length during ordinary manufacture whereby a separate hollow-forming or hole-forming step is avoided.

In a preferred embodiment of the invention, the support member is generally channel-shaped and comprises a central web and a pair of limbs extending rearwardly from opposite sides of the web. The web is rearwardly recessed adjacent one of the limbs to form a forward-facing shelf extending along substantially the entire length of the support member. Thus the support member, including the shelf, can be easily extruded or rolled from a suitable material such as heavy aluminum with substantially no more trouble or expense than is involved in making a conventional support member which must later be cut to provide a hollow.

The insert means preferable comprises a pair of longitudinally spaced-apart tab elements each disposed adjacent a respective end of the strike plate opening. Each tab element comprises a first portion which is disposed directly rearwardly of the strike plate opening to provide a strike plate mounting surface to which the strike plate is attached. A second portion preferably extends longitudinally from the first portion of each tab element to underlie and abut the rear of the front section of the jamb member and thus retain the attached strike plate in the door jamb. One of the principal advantages of the invention is thus the fact that the insert means which provides the strike plate mounting surface can be emplaced through the strike plate opening in the jamb member after installation of the jamb member in the doorway and is removable in like manner. Furthermore, neither the insert means nor the strike plate need be directly affixed to the support member or to the jamb member. Also, the insert means, prior to its attachment to the strike plate, can be moved, at least in the longitudinal direction for proper positioning.

In the preferred embodiments, the insert support surface abuts the insert means when the apparatus is fully assembled whereby the strike plate mounting surface may be used to support the strike plate against rearward movement (i.e. movement away from the door opening). However, in some embodiments it is possible to provide other means for supporting the strike plate independently of the insert means whereby the latter need only provide a site for attachment of the strike plate and a means of retaining it in the door jamb and against forward movement, i.e. movement toward the door opening.

The above-mentioned tab elements preferably have, at their inner edges, transverse forward-projecting ridges, and the sections of the tabs immediately adjacent the ridges are offset rearwardly from the ridges. Thus, as the attachment means which fastens the strike plate to the tab elements is tightened to draw the offset sections toward the strike plate, the longitudinally outer edges of the tabs are urged tightly against the rear of the front section of the jamb member.

Accordingly it is a principal object of the present invention to provide a door jamb strike plate mounting assembly including an insert disposed rearwardly of the strike plate and providing a strike plate mounting surface.

Another object of the present invention is to provide an improved strike plate mounting assembly which is particularly useful in connection with metal, especially aluminum, door jambs.

Yet a further object of the present invention is to provide a strike plate mounting assembly insert which can be easily installed after mounting of the associated jamb member in the doorway.

Still another object of the present invention is to provide an improved support member for a wall construction.

One more object of the present invention is to provide a strike plate mounting assembly which eliminates the need for forming a hollow of limited longitudinal extent in the jamb support stud.

Other objects, features and advantages of the present invention will be made apparent by the following description of preferred embodiments, the drawing, and the claims.

BRIEF DESCRIPTION OF THE DRAWING

FIG. 1 is an isometric view, with parts broken away, of a door jamb incorporating a first embodiment of the present invention.

FIG. 2 is an isometric view of the insert means of FIG. 1.

FIG. 3 is a longitudinal cross section taken on lines 3—3 of FIG. 1.

FIG. 8 is an isometric view, with parts broken away, of a door jamb incorporating a third embodiment of the present invention.

FIG. 9 is a longitudinal cross section taken on lines 9—9 of FIG. 8.

FIG. 10 is a transverse cross section, similar to those of FIGS. 4 and 7, through a door jamb incorporating a fourth embodiment of the present invention.

DESCRIPTION OF THE PREFERRED EMBODIMENTS

Referring now to FIGS. 1–4, there is shown a first embodiment of the strike plate mounting assembly of the invention associated with the side jamb member of a door frame. The jamb member comprises a front section 10 which is disposed along a doorway edge of a wall. As used herein, the forward direction will be into the doorway or away from the wall edge, and the rearward direction will be away from the doorway or toward the wall edge, terms such as "front" and "back" being defined accordingly. Similarly, the longitudinal direction and lateral or sideways direction will be defined with reference to the front section 10 of the jamb member unless otherwise stated.

Figure 4:
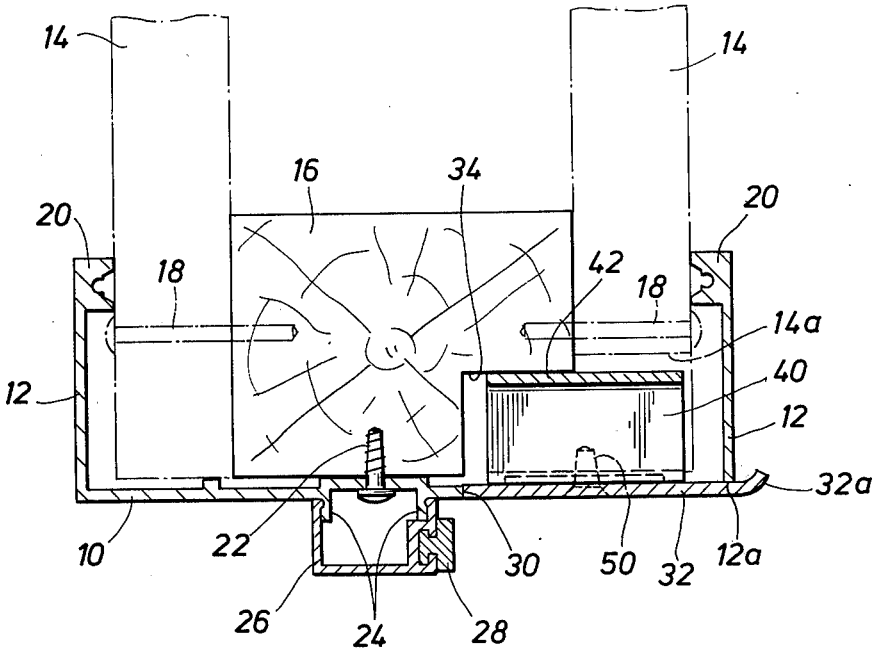
FIG. 4 is a transverse cross section taken on lines 4—4 of FIG. 1.

In addition to the front section 10, the jamb member comprises a pair of wing sections 12 each extending rearwardly from a respective side edge of front section 10 to lie along the wall. The wall itself is comprised of a pair of parallel panels 14, and an elongate support stud 16 of wood is disposed between the panels at their front edges and secured thereto by screws 18. Stud 16 may extend along the entire length of the door jamb or may be somewhat shorter. Wing sections 12 are spaced slightly from their respective panels 14 by rear laterally inwardly directed flanges 20 which abut the wall panels 14. The front section 10 is secured to the stud 16 by screws 22. A pair of longitudinally extending flanges 24 project forward on either side of the screws 22. A longitudinally extending cover 26 is snapped over the flanges 24 as shown in FIG. 4 to hide the screws 22 and form a door stop. Cover 26 also carries, on one side thereof, a snap-in sealing gasket 28.

In the gasket side of front section 10 there is formed a strike plate opening 30 and a strike plate 32 is disposed therein. Opening 30 extends into the adjacent wing section 12 a short distance to allow a curved extension **32*a* of the strike plate 32 to project therefrom. The forward edge portion 12*a* of the wing section adjacent the opening 30 serves to help support the strike plate 32 and keep it flush with the forward surface of front section 10**.

The support stud 16 is recessed at the forward corner closest to the strike plate opening 30 to form a forward-facing shelf 34 spaced rearwardly from and aligned with the strike plate opening 30. The recess in stud 16 provides the necessary hollow to receive the bolt carried on the door lock (not shown). If the adjacent panel 14 is also partially aligned with the strike plate opening 30, it may be cut back as shown at **14*a* at least as far as the shelf 34 in the area of the strike plate opening. To allow for versatility in the placement of the strike plate 32 and associated apparatus, both the shelf 34 and the cut 14*a* may have substantial longitudinal extent, being a good deal longer than the strike plate opening 30**, and may even extend along the entire length of the respective stud or wall panel.

In the embodiment of FIGS. 1–4, stud 16 also serves as the support means, a portion of surface 34 being the insert support surface. In embodiments such as this one, in which the insert support surface is formed exclusively by the shelf on the support stud, the portion of this shelf underlying the strike plate opening should be preferably at least one-fourth as wide as the narrower portions of the strike plate and strike plate opening, i.e. at least one-fourth the distance between the side edges 32*b* and 32*c* of the portion of strike plate 32 exclusive of its extension 32*a*.

An insert 36 is disposed between the front section 10 and the shelf 34. The insert 36 includes a pair of longitudinally spaced apart tabs 38, a respective connector 40 depending rearwardly from the longitudinally inner edge of each tab 38, and a base 42 generally parallel to the tabs 38 and joining the rear edges of connectors 40. As best seen in FIG. 2, each of the tabs 38 has a forward-projecting ridge 44 at its longitudinally inner edge. Thus, the section of each tab 38 immediately adjacent its ridge 44 is offset rearwardly from the ridge. Each tab 38 is, in the relaxed state prior to assembly, inclined slightly forwardly from the section immediately adjacent the ridge 44 to the longitudinally outer edge 46 as indicated by the angle between line *m*, parallel to the forward surface of one of the tabs 38 exclusive of its ridge, and vertical line *n* in FIG. 2. In actual practice, this angle is quite small, perhaps about 2°; it has been exaggerated, however, for purposes of illustration. The insert 36 is preferably formed of a single piece of metal plate bent to the configuration shown in FIG. 2 and such that the tabs 38 will have some spring characteristics.

In assembling the apparatus, the stud is first mounted between the panels 14. The jamb member 10, 12 is then emplaced and secured to the stud 16, the strike plate opening 30 having been pre-formed therein. The insert 36 is then placed between front section 10 and shelf 34 as shown through the strike plate opening 30 and may be moved about with respect to both the stud 16 and the jamb member 10,12 for proper positioning. The insert is also removable through the strike plate opening. Connectors 40 are sized so that, with the base 42 abutting portion 34*a* of shelf 34, the longitudinally outer edges of the tabs 38 contact the rear of the front section 10 and are deflected rearwardly thereby. Thus, the forward surfaces of the tabs 38 now lie substantially parallel to the front section 10. This also causes the insert 36 to lightly jam itself between front section 10 and surface 34*a* to maintain proper positioning until the remaining parts are assembled. However, it will be appreciated that the inclination of tabs 38 could be eliminated since even without the jamming action, the ridges 44 will generally project forward sufficiently to prevent the insert from falling down between the jamb member and the wall.

By reference to FIGS. 1 and 3 it will be seen that, with the insert 36 properly in place, each of the tabs 38 has a longitudinally inner portion 38*a*, which includes ridge 44, and which is disposed directly rearwardly of, i.e. exposed by, strike plate opening 30 to provide a strike plate mounting surface. A second portion 38*b* extends longitudinally outwardly from each portion 38*a* to abut the rear of the front section 10. An aperture 48 is provided in each portion 38*a* for receipt of a screw 50 which attaches the strike plate 32 to the strike plate mounting surface.

At this point, the strike plate 32 could be attached to the strike plate mounting surfaces provided by portions 38*a* of tabs 38. However, it is noted that the front section 10 comprises a plate-like portion 10*a* and a plurality of longitudinally extending ledges 10*b* depending rearwardly therefrom. Since the tabs 38 abut the ledges 10*b* rather than the plate-like portion 10*a* of front section 10, the effective thickness of the front section 10 is the thickness of plate-like portion 10*a* plus the thickness of ledges 10*b* which, as best seen in FIG. 3, is greater than the thickness of strike plate 32. Thus, emplacement of strike plate 32 and tightening of screw 50, at this point, would tend to push front section 10 forward adjacent the strike plate so that it would not be flush therewith. Accordingly, a shim or washer 52, having an opening 54 for receipt of screw 5, is disposed between each tab portion 38*a* and the strike plate 32 to equalize the effective thicknesses of the front section 10 and the strike plate 32 adjacent opening 30.

The strike plate 32 can now be firmly attached to the strike plate mounting surfaces by screws 50. As these screws are tightened, they tend to draw the rearwardly offset sections of tabs 38 forward with the ridges 44 acting as fulcrums. The tabs are thus urged tightly against the rear of the front section 10. This retains the strike plate against forward movement with respect to the front section. The use of the washers 52 assures that the front sufaces of the strike plate 32 and the front section 10 will remain flush. At the same time, with the base 42 of the insert abutting the insert support surface 34*a*, the strike plate mounting surfaces provided by tab portions 38*a*, and including ridges 44, support the strike plate 32 against rearward movement with respect to the front section 10. Finally, the abutment of the edges of the strike plate 32 with the edges of the strike plate opening 30 firmly anchors both the strike plate and the attached insert 36 against lateral and longitudinal movements. Thus both the strike plate 32 and insert 36 are held in fixed position although neither one is directly affixed to either the stud 16 or the jamb member 10,12. The recess in stud 16 forming shelf 34, the space between tabs 38, and the rearward offsetting of base 42 with respect to the tabs, provides a hollow behind the central portion of the strike plate 32, which in turn has an aperture 56 for receipt of the bolt on the door lock. The insert, particularly the connectors 40 and base 42, also serves as a dust cover behind aperture 56.

Figure 7:
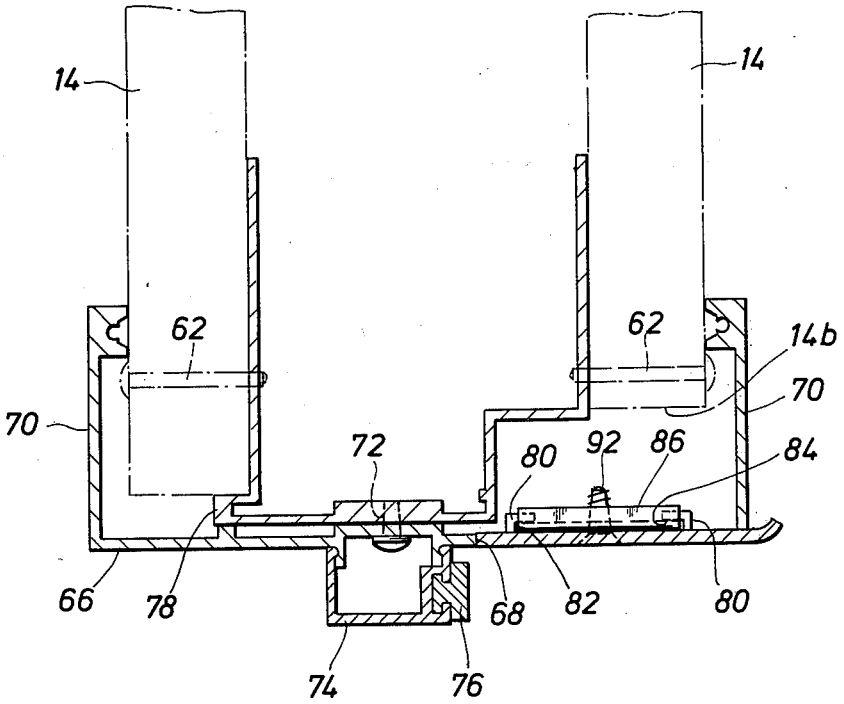
FIG. 7 is a transverse cross section taken on lines 7—7 of FIG. 5.
Figure 5:
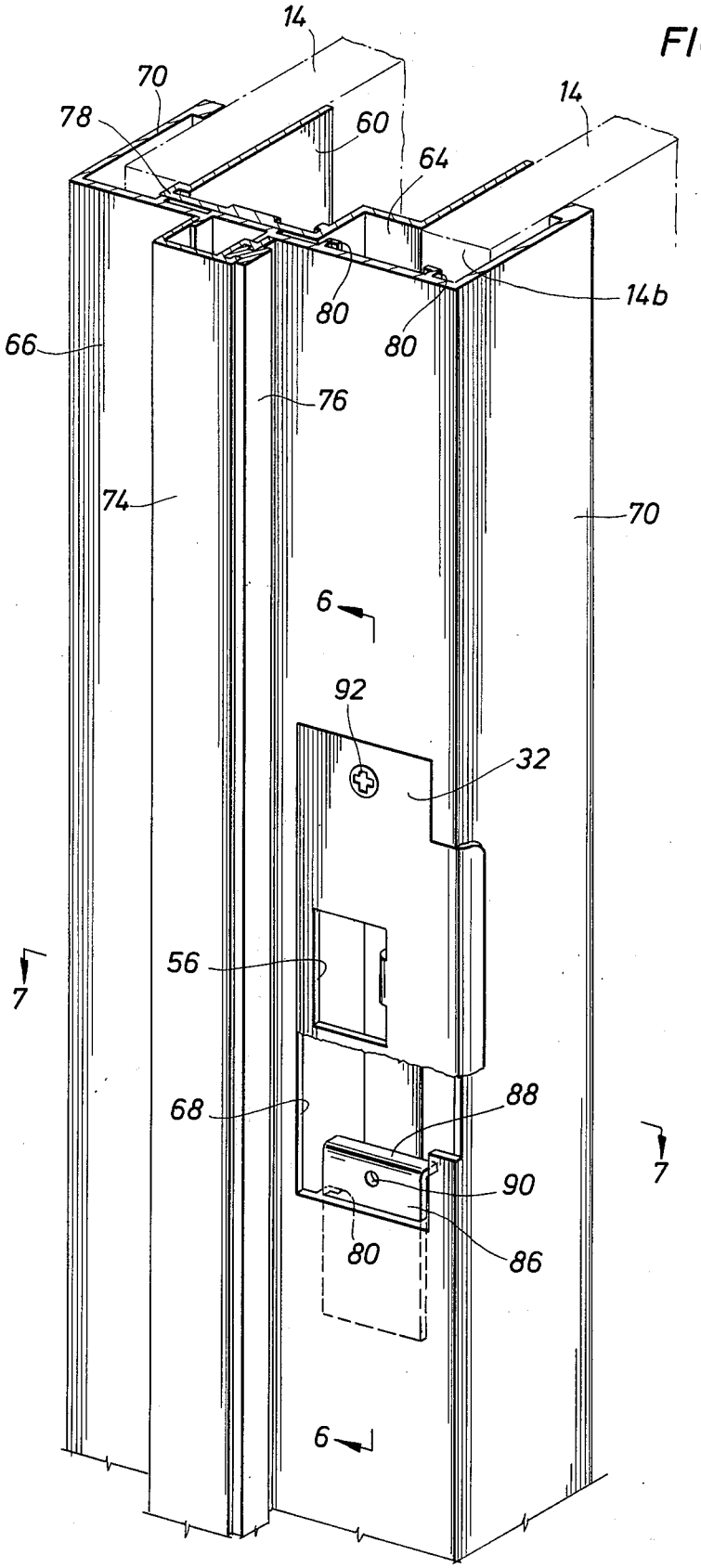
FIG. 5 is an isometric view, with parts broken away, of a door jamb incorporating a second embodiment of the invention.
Figure 6:
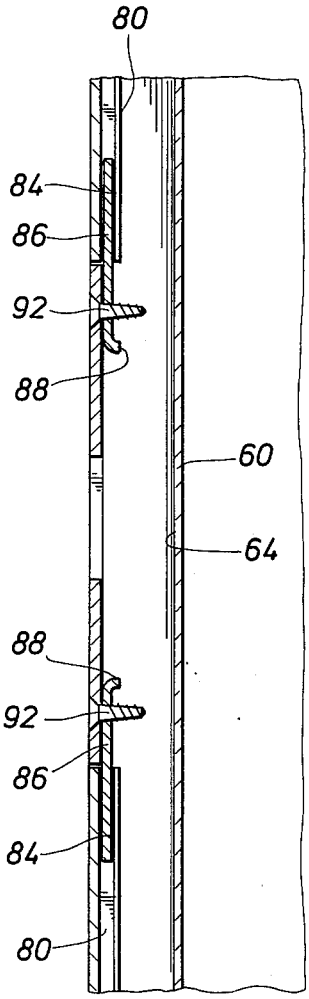
FIG. 6 is a longitudinal cross section taken on lines 6—6 of FIG. 5.

Turning now to FIGS. 5–7, there is shown a second embodiment of the invention. Again the construction includes a pair of parallel wall panels 14 with a support stud 60 secured therebetween by bolts 62. The stud 60 is a generally channel shaped member of metal comprising a central web 60*a* and a pair of limbs 60*b* extending rearwardly from opposite sides of web 60*a* disposed between and abutting respective ones of the wall panels 14. Stud 60 otherwise has much the same external transverse cross-sectional configuration as the solid wooden stud of FIGS. 1, 3 and 4. In particular, stud 60 has a recess at the forward corner closest to the strike plate, i.e. web 60*a* is recessed rearwardly adjacent one of the limbs 60*b*, the recess extending along the entire length of stud 60 and forming a forward-facing shelf 64 spaced rearwardly from and aligned with a strike plate opening 68 in the front section 66 of the associated jamb member. This shelf 64 can be easily formed during manufacture of the stud 60 as a whole without the need for a separate shelf-forming step or operation. In particular, the stud 60, including shelf 64, may be extruded or cold-rolled of aluminum or the like. The wall panel 14 closest to the strike plate is set or cut back as indicated at 14*b* about as far as the shelf 64 along its entire length.

The jamb member is much like that of FIGS. 1, 3 and 4 and comprises a front section 66 and wing sections 70. Front section 66 is secured to stud 60 by screws 72 whose heads are hidden from view by a snap-on cover 74 carrying a gasket 76. A lateral projection 78 on the stud 60 serves to space the front section 66 from the wall panel 14 distal the strike plate and thus help to position and stabilize the jamb member.

The insert support means are comprised of two pair of longitudinally extending flanges 80 depending generally rearwardly from front section 66 adjacent respective longitudinal ends of the strike plate opening 68. The flanges are L-shaped in transverse cross section, and each pair is arranged to form, with the rear surface of the front section 66, a pair of opposed laterally opening channels 82 for receipt of the insert means. It will be appreciated that each of these channels 82 is partially defined by a forward-facing insert support surface 84 on the respective flange 80 spaced rearwardly from the front section 66. Although the flanges 80 may be formed integrally with the front section 66 they are not considered part of the front section proper as defined herein.

The insert means comprise two tabs 86 having generally planar forward surfaces and small rearward projections 88 adjacent their longitudinally inner edges. Although rearward projections 88 are not essential to the operation of the tabs 86, they may be helpful, for example, in supporting the lowermost tab on the flanges 80 during assembly until the remainder of the strike plate mounting assembly can be positioned. Each tab 86 has, in use, a longitudinally inner portion disposed directly rearwardly of, i.e. exposed by, the strike plate opening 68 which provides a strike plate mounting surface and which has an aperture 90 therein. Each tab 86 also has a longitudinally outer portion which abuts the rear of the front section 66 to retain the strike plate from falling forward out of the strike plate opening. At the same time, insert support surfaces 84 abut the rear of tabs 86 to prevent both the tabs and the strike plate 32 from moving rearwardly. The shelf 64 and the set back wall panel **14*b* provide the necessary hollow behind strike plate aperture 56**.

Turning now to FIGS. 8 and 9, there is shown a manner in which the invention can be adapted for doorways in which there is no support stud between the wall panels 14 at the door opening. The jamb member is similar to that of FIGS. 5–7 and comprises a front section 94 and wing sections 96. The wing sections 96 are attached directly to the wall panels 14 by screws 98. For aesthetic purposes, the screws may be hidden by decorative covers 100 which snap onto projections 102 on the exterior of the wing sections 96. As in the embodiment of FIGS. 5–7, the front section 94 has a strike plate opening 104 and, adjacent each longitudinal edge of this opening, a pair of L-shaped flanges 106. Each pair of flanges 106 forms, with the rear surface of front section 94, a pair of opposed laterally opening channels each of which is partially defined by a forward facing insert support surface 108 spaced rearwardly from the front section 94.

The insert comprises a pair of longitudinally spaced-apart tabs 110. Each tab 110 has a longitudinally inner portion which provides a strike plate mounting surface and a longitudinally outer portion which is received in the channels of flanges 106 to abut the insert support surfaces 108 and the rear of the front section 94 and thus retain the strike plate 32 against both forward and rearward movement. Strike plate 32 is attached to the strike plate mounting surfaces by bolts 116 through apertures 118 in the strike plate mounting surfaces.

The tabs 110 have substantially planar forward surfaces like the tabs 86 of FIGS. 5–7 and do not include the ridges, offset sections, and inclination of the tabs 38 of FIGS. 1–4. However, connectors 112 are provided depending rearwardly from the longitudinally inner edge of each tab 110, and the connectors 112 are joined by a base 114 to provide a dust cover behind strike plate aperture 56.

Referring now to FIG. 10, there is shown still another embodiment of the invention. Here the jamb member 126, 128, wall panels 14, and support stud 120 are similar to those of FIGS. 5–7. However, there are no channel-forming flanges depending rearwardly from the front section 126. Stud 120 has its forward portion **120*a* extending laterally slightly beyond the edge of strike plate opening 130. At the corner edge of stud 120 thus exposed by the strike plate opening 130 is forward projection 122. This projection 122, together with the forward edge 128*a* of the adjacent wing section 128 exposed by strike plate opening 130, support the strike plate 32 against rearward movement independently of the insert 124. Insert 124 is substantially identical with that of FIGS. 8 and 9**.

Stud 120 has a recess forming a forward-facing shelf 132 spaced rearwardly from and aligned with the strike plate opening 68, and the adjacent wall panel 14 is cut or set back adjacent the shelf 132 as shown. A portion of shelf 132 serves as an insert support surface to limit rearward movement of insert 124 to allow initial engagement therewith of the screws which attach the insert to the strike plate 32. The lateral surface **120*b* of the stud recess prevents the insert from rotating as the screws are tightened whereby the insert 124 is drawn forward to abut the rear of front section 126 as in the other embodiments. Thus, the insert again provides strike plate mounting surfaces and serves to prevent the strike plate from falling forward out of the strike plate opening 130. However, since the strike plate 32 is supported against rearward movement by projection 122 and wing edge 128*a* independently of the insert 124, there is no need for the insert to abut the insert support surface 126** after assembly.

The present invention provides numerous advantages over the prior art. In particular, it provides an especially easily assembled strike plate mounting assembly which is adaptable to various types of door frame construction and which allows for versatility in the vertical placement of the strike box. The insert providing the strike plate mounting surfaces can be installed through the strike plate opening after mounting of the door jamb in the doorway and is removable therefrom. The insert is also movable with respect to the stud and the jamb prior to its attachment to the strike plate, and both the strike plate and the insert are retained in place without being directly affixed to the stud or the jamb. The necessary hollow is formed by a recess in the support stud and/or by cutting or setting the adjacent wall panel back. Both the recess in the stud and the offset portion of the wall panel can have a substantial longitudinal extent, much longer than the strike plate opening in the door jamb member, which allows the aforementioned versatility in placement of the strike plate opening and adjacent parts. In particular, the recess or offset can extend along the entire length of the respective stud or wall panel. Thus, the recess or offset can be formed at the time of initial manufacture of the stud or construction of the wall respectively whereby the recessing and offsetting takes little more time than ordinary construction. This is particularly advantageous with regards to the recessing of metal support studs. The invention, in those forms which involve one piece inserts, also provides an aesthetically pleasing dust cover for the interior of the latch bolt-receiving hollow.

Many modifications of the embodiments described above can be made without departing from the invention. In particular, in some instances in which the wall panel adjacent the strike plate mounting assembly is not aligned with the insert or the aperture in the strike plate, it is not necessary to offset this panel. Furthermore, many of the features of the various embodiments disclosed can be interchanged or modified. For example, the insert means of FIGS. 1–4 can be used with the embodiments of FIGS. 5–9, if the tab-receiving channels are suitably sized, as well as with the embodiments of FIGS. 8–9 or FIG. 10. The tabs of FIGS. 5–7 could be provided with rearwardly extending legs to abut the shelf 64 and with ridges and offset sections as in the tabs of FIGS. 1–4. Similarly, an insert such as that of FIGS. 8–9 without ridges, offset sections or inclination of the tabs could be used with the remaining apparatus of FIGS. 1–4. Metal, wooden or other types of support studs can be used with any embodiment as desired. Accordingly it is intended that the scope of the invention be limited only by the claims which follow.

I claim:

1. A door jamb strike plate mounting assembly comprising:

a jamb member including a front section, said front section having a strike plate opening therein;

insert means insertable through said strike plate opening, disposed rearwardly of said front section, and providing a strike plate mounting surface for backing of a strike plate, said mounting surface being disposed directly rearwardly of said strike plate opening, said insert means further including a portion rearwardly underlying said front section of said jamb member;

a strike plate disposed in said strike plate opening and backed by said mounting surface;

attachment means rigidly attaching said strike plate to said insert means;

a support means located rearwardly of and fixed independently of said strike plate with respect to said front section adjacent said strike plate opening and including means operative to limit rearward movement of said insert means.

2. A strike plate mounting assembly as set forth in claim 1 wherein said means to limit rearward movement of said insert means comprises a forward-facing insert support surface on said support means.

3. A strike plate mounting assembly as set forth in claim 1 further comprising a strike plate disposed in said strike plate opening and means adjacent said strike plate opening rearwardly abutting said strike plate to limit rearward movement of said strike plate with respect to said front section independently of said insert means.

4. A door jamb strike plate mounting assembly comprising:

a jamb member including a front section, said front section having a strike plate opening therein;

insert means insertable through said strike plate opening, disposed rearwardly of said front section, and providing a strike plate mounting surface for backing of a strike plate, said mounting surface being disposed directly rearwardly of said strike plate opening, said insert means further including a portion rearwardly underlying said front section of said jamb member;

a support means comprising a support stud disposed rearwardly of and fixed with respect to said front section adjacent said strike plate opening, said support stud having a recess therein, said recess forming a forward facing shelf spaced rearwardly from and aligned with said strike plate opening and of substantially greater longitudinal extent than said strike plate opening with respect to said front section of said jamb member, said support stud being operative to limit rearward movement of said insert means.

5. A strike plate mounting assembly as set forth in claim 4 wherein said recess extends along the entire length of said support stud.

6. A strike plate mounting assembly as set forth in claim 2 wherein said insert support surface abuts said insert means.

7. A door jamb strike plate mounting assembly comprising:

a jamb member including a front section, said front section having a strike plate opening therein;

insert means insertable through said strike plate opening, disposed rearwardly of said front section, and comprising two substantially parallel longitudinally spaced-apart tab elements forming two respective strike plate mounting surfaces for backing of a strike plate, each of said tab elements being disposed adjacent a respective end of said strike plate opening and having a first portion disposed directly rearwardly of said strike plate opening and forming a respective one of said strike plate mounting surfaces and a second portion extending longitudinally from said first portion and rearwardly underlying said front section.

8. A strike plate mounting assembly as set forth in claim 7 further comprising a strike plate disposed in said strike plate opening backed by said strike plate mounting surfaces and attachment means operative to attach said strike plate to said first portions of said tab elements.

9. A strike plate mounting assembly as set forth in claim 8 wherein each of said tab elements comprises a longitudinally inner edge, a longitudinally outer edge, and a transverse forward projecting ridge at said inner edge, a section of said first portion of said tab element immediately adjacent said ridge being offset rearwardly from said ridge, and said attachment means being operative to draw said offset section toward said strike plate thereby urging said outer edge of said tab element against the rear of said front section.

10. A strike plate mounting assembly as set forth in claim 9 wherein each of said tab elements has spring characteristics and is, in a relaxed condition, inclined in the forward direction from said offset section to said outer edge.

11. A strike plate mounting assembly as set forth in claim 9 wherein the effective thickness of said front section is greater than that of said strike plate and comprising means substantially equalizing the effective thicknesses of said strike plate and said front section adjacent said strike plate mounting surfaces.

12. A strike plate mounting assembly as set forth in claim 11 wherein said equalizing means comprises a pair of washers each disposed between said strike plate and a respective one of the first portions of said tab elements.

13. A strike plate mounting assembly as set forth in claim 9 further comprising flange means depending generally rearwardly from said front section adjacent said strike plate opening and configured to form opposed laterally facing channels receiving said second portions of said tab elements and forming a plurality of insert support surfaces.

14. A strike plate mounting assembly as set forth in claim 9 wherein said support means comprises a support stud disposed rearwardly of said front section, said support stud having a recess therein, said recess forming a forward facing shelf spaced rearwardly from and aligned with said strike plate opening, wherein said support surface is comprised of a portion of said shelf, and wherein said insert means further comprises a base abutting said support surface and a pair of connector elements each connecting said base to a respective one of said inner edges of said tab elements.

15. A strike plate mounting assembly as set forth in claim 14 wherein said insert means is formed of an integral piece of metal plating.

16. A strike plate mounting assembly as set forth in claim 14 wherein said shelf is substantially longer than said strike plate opening.

17. A strike plate mounting assembly as set forth in claim 14 further comprising a wall having two parallel spaced-apart panels and said panels having forward facing end surfaces disposed rearwardly of said front section, said support stud being disposed between said panels adjacent said end surfaces and said shelf being disposed at a corner of said support stud directly adjacent one of said panels, wherein said one of said panels has its end surface offset rearwardly at least as far as said shelf in the area adjacent said shelf.

18. A strike plate mounting assembly as set forth in claim 17 wherein said jamb member further comprises a pair of wing sections each depending from a respective lateral edge of said front section and extending along a part of the exterior surface of a respective one of said panels.

19. In a wall construction having a door opening therein and comprising two generally parallel spaced-apart wall panels, said panels having respective edge portions facing into said door opening, and a jamb member overlying said edge portions, the improvement comprising:

an elongate generally channel-shaped support member disposed rearwardly of said jamb member adjacent said door opening, said support member comprising a central web and a pair of limbs extending rearwardly from opposite sides of said web, said web being rearwardly recessed adjacent one of said limbs to form a generally forward-facing shelf spaced from said jamb member and extending along substantially the entire length of said support member.

20. The wall construction of claim 19 wherein said web abuts said jamb member.

21. The wall construction of claim 19 wherein said limbs are disposed generally between said wall panels.

22. The wall construction of claim 19 wherein said support member is an extruded member.

* * * * *